United States Patent [19]
Klein et al.
[11] 4,243,603
[45] Jan. 6, 1981

[54] PROCESS FOR THE PRODUCTION OF A LIQUID EDIBLE OIL FROM FATTY MATERIALS HAVING A HIGH CONTENT OF SATURATED FATTY ACIDS AND THE OIL PRODUCED BY THE PROCESS

[75] Inventors: Jean M. Klein, Couderque-Branche; Albert Lacome, Dunkerque, both of France

[73] Assignee: Lesieur-Cotelle & Associes S.A., Hauts de Seine, France

[21] Appl. No.: 43,935

[22] Filed: May 31, 1979

[30] Foreign Application Priority Data

May 31, 1979 [FR] France ..... 78 16182

[51] Int. Cl.[3] ..... C11C 3/02
[52] U.S. Cl. ..... 260/410.7; 426/607
[58] Field of Search ..... 260/410.7; 426/607

[56] References Cited

U.S. PATENT DOCUMENTS

| | | | |
|---|---|---|---|
| 2,442,535 | 6/1948 | Eckey | 260/410.7 |
| 2,442,539 | 6/1948 | Eckey | 260/410.7 |
| 2,855,311 | 10/1958 | Nelson | 260/410.7 |
| 2,875,066 | 2/1959 | Holman et al. | 260/410.7 |
| 3,686,240 | 8/1972 | Kawada et al. | 426/607 |
| 4,055,679 | 10/1977 | Kattenberg et al. | 426/607 |

OTHER PUBLICATIONS

Babin-Oleagineux, No. 7, Jul. 1974, pp. 375-378.

*Primary Examiner*—John F. Niebling
*Attorney, Agent, or Firm*—Seidel, Gonda, Goldhammer & Panitch

[57] ABSTRACT

A process for the production of a liquid edible oil having properties which are comparable to those of commercially available edible oils.

The fatty material to be treated is interesterified and then fractionated by means of a suitable solvent under specific conditions of temperature and fatty material/-solvent ratio.

There is produced a fluid fraction which essentially comprises unsaturated triglycerides with an iodine number of higher than 75, an end-of-clouding point of less than 12° C. and a relatively high content of tocopherols.

16 Claims, 2 Drawing Figures

Figure 1:
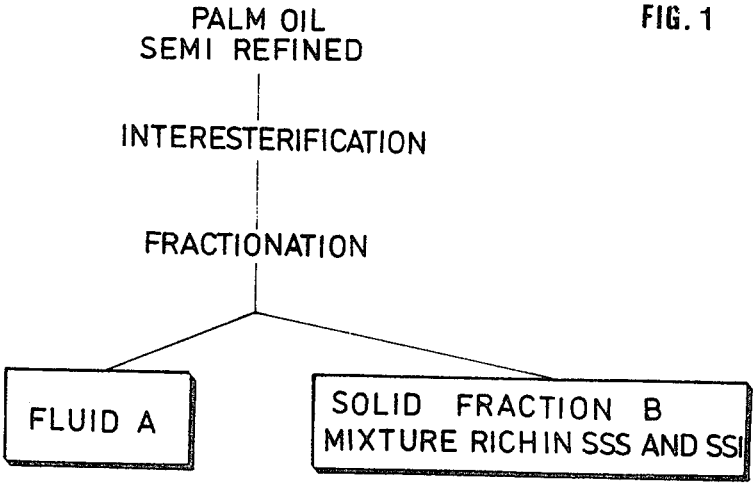

PROCESS FOR THE PRODUCTION OF A LIQUID EDIBLE OIL FROM FATTY MATERIALS HAVING A HIGH CONTENT OF SATURATED FATTY ACIDS AND THE OIL PRODUCED BY THE PROCESS

The present invention relates to a process for the production of a fluid edible fraction from natural fatty materials having a high content of saturated fatty acids and in particular from natural fatty materials having a ratio between saturated and unsaturated substances, which ranges from approximately 0.3 to approximately 1.2; the invention also relates to the resulting fluid fraction.

It is known that natural fatty substances are generally complex mixtures of triglycerides, the composition of which includes saturated fatty acids (solid) and unsaturated fatty acids (fluid) of different chain lengths. The fatty acid composition and the distribution of the fatty acids within the triglyceride molecules are particular to each type of oil and determine the melting point thereof. However, in the case of mixtures which form natural fats, intersolubility phenomena occur.

As regards the composition of palm oil which is at present on the market, a certain equilibrium can be observed between the total content of saturated and unsaturated fatty acids, with one or other of such acids predominating, according to the country of origin and the variety. However, the distribution of the fatty acids in the molecule makes it difficult to separate them clearly into two fractions: the amounts of tri-unsaturated triglycerides (with three unsaturated fatty acids) and tri-saturated triglycerides (with three saturated fatty acids) are small, whereas, with the present-day varieties, the disaturated-monounsaturated acids and the monosaturated-diunsaturated acids are present in almost equal quantities, that is to say, about 45%, which can develop in the future with new varieties of palm-trees, for example the Guineansis-Melanococca hybrid. Now, in order to produce an oil which is comparable to the vegetable oils on the market, it is necessary to separate from the palm oil, the most highly unsaturated triglycerides (with two double bonds or more) corresponding primarily to triglycerides having two or three unsaturated fatty acids in the molecule.

It has been found that the processes for fractionating the natural fatty material used do not make it possible to achieve satisfactory separation of the fluid fraction desired, which essentially comprises unsaturated fatty acids; indeed, the chemical structure of the fatty substance, in the present case the palm oil, is a factor which limits the degree of separation of the fluid fraction and the solid fraction containing the saturated fatty acids, so that, whatever fractionating processes are employed, a substantial part of the unsaturated fatty acids remains in the solid fraction. From this consideration, the inference has been drawn that satisfactory separation of the fluid fraction can be achieved only by attacking the chemical structure of the triglyceride molecule of the palm oil, in order to displace the unsaturated fatty acids which are in the triglycerides consisting of two saturated acids and an unsaturated acid, towards an essentially unsaturated formation. One of the most important and most flexible means for modifying the chemical structure of the fatty substances so as preferentially to recover the total amount of unsaturated fatty acids which they contain is represented by interesterification, which can be defined as being a modification to the glyceride structure of the fatty substances, by molecular re-arrangement of the fatty acids on the glycerol, by breaking and reforming the ester bonds.

A large number of processes for the interesterification of fatty substances intended for human foodstuffs have been proposed in the prior art, for the purposes of isolating a fluid fraction. The art includes in particular U.S. Pat. No. 2,442,539 wherein interesterification is performed at a temperature of the order of 49° C. and is followed by a fractionating step at 18° C., in a solvent which is present in a proportion which is of the order of four times the amount of oil treated, and includes steps for recycling of the solid fraction obtained from the fractionating step, at the same time as the fluid fraction. This is also the case with the process described in the publication BABIN (OLEAGINEUX, 29th year, No. 7, July 1974, pages 375–378) which provides for fractionating by centrifuging in the presence of a surface-active agent in order to produce a solid fraction and a fluid fraction which is subjected to interesterification at 33°–36° C., wherein the order of these two stages in the process can be reversed in order to improve the proportion and the quality of the fluid fraction produced. A process seeking to produce a fluid fraction has also been proposed, whose principle is based on a transesterification reaction of palm oil with fatty acid esters of a $C_1$–$C_3$ alkanol (French Pat. No. 75 35734). However, these processes known in the prior art suffer from a certain number of disadvantages. In particular, the fluid fraction obtained in U.S. Pat. No. 2,442,539 does not have a sufficiently high content of unsaturated fatty acids, which does not permit it to provide fluidity qualities which are comparable for example with peanut oil. As regards the process disclosed in the above-quoted article which appeared in the review 'OLEAGINEUX,' although it makes it possible to separate a fluid fraction which essentially comprises unsaturated triglycerides, nonetheless the characteristics of the fluid fraction produced, and in particular its iodine number (73 ) are such that it also does not have qualities which are actually comparable to those of commercially available edible oils (peanut oil and olive oil in particular) and cannot therefore constitute a satisfactory substitute for the latter.

The aim of the present invention is to provide a process for the production of an edible oil from fatty materials containing a high proportion of saturated fatty acids, which better fulfils the requirements which arise in practice, than the previously proposed processes seeking to achieve the same aim, in particular insofar as it provides for the production of a fluid oil having properties similar to those of commercially available edible oils such as peanut oil and olive oil, in particular, and more particularly physical-chemical characteristics which are similar to those of such oils, using exclusively processes which are authorised by the legislation, and which also have a ratio of tocopherols to unsaturated fatty acids, which is extremely favourable from the nutritional point of view and which is higher than that of the above-mentioned edible oils.

The present invention provides a process for the production of an edible oil from fatty materials having a high content of saturated fatty acids, in which, in a first stage, interesterification of the fatty material to be treated is performed at temperatures of from 20°, preferably 30°, to 80° C. in the presence of a suitable interesterification catalyst and, in a second stage, the interesterified fatty material is subjected to at least one fractionating step, by means of a suitable solvent for fractionating fats, at a temperature of from −20° to +35° C.

Preferably the fatty material is subjected to a free interesterification process in oil phase at a temperature of from 60° to 80° C. for a period of from 30 to 60 minutes in the presence of a suitable interesterification catalyst.

The fatty material to be treated is preferably subjected to a directed interesterification process in oil phase or in solvent phase at a temperature of from 30° to 40° C. for a period of from 1 to 24 hours and preferably from 1 to 3 hours in the presence of a suitable interesterification catalyst.

The interesterification catalyst is preferably selected from alkali metal alcoholates, for example sodium methylate, sodium metal or sodium-potassium alloy, the catalyst being present in a proportion of from 0.1 to 0.4% by weight with respect to the weight of the fatty material to be treated.

When the directed interesterification operation is carried out in solvent phase, the solvent used is preferably a halogenated or non-halogenated hydrocarbon such as trichlorotrifluoroethane or hexane, in particular used in a fatty material: solvent ratio by weight of from 1:0.05 to 1:0.4.

The fractionating stage is preferably carried out in a single operation using as solvent trichlorotrifluoroethane or hexane, at temperatures of from −20° C. to −10° C., the fatty material: solvent weight ratio being from 1:2 to 1:7.

In accordance with another advantageous embodiment of the process of the invention, the fractionating stage comprises at least two successive fractionating operations, namely, a first operation for fractionating the interesterified fatty material, by means of a suitable fat-fractionating solvent, preferably trichlorotrifluoroethane, hexane, isopropanol or acetone, present in an oil:solvent weight ratio of from 1:0.5 to 1:7, for a period of from 2 to 4 hours, at a temperature of from 0° to +35° C., followed by a second operation of fractionating the fluid fraction produced from the first fractionating operation, in a suitable fat-fractionating solvent, preferably trichlorotrifluoroethane or hexane, present in an oil:solvent weight ratio of from 1:2 to 1:7, for a period of from 2 to 4 hours, at a temperature of from −10° to −20° C., to produce an edible fluid fraction essentially comprising unsaturated triglycerides, which is recovered by separation of the solid fraction that is also produced.

In accordance with one form of this embodiment of the process, the solid fraction produced from the second fractionating operation is recycled to the head of the process, in the fatty material to be treated, so as to be interesterified jointly with the fatty material to be treated.

The process according to the present invention makes it possible to produce a fluid fraction that essentially comprises unsaturated triglycerides whose iodine number is higher than 75, whose end-of-clouding point is lower than 12° C., whose tocopherol content is higher than 0.035%, and in which the quantity $$\frac{\text{mg of tocopherols per 100 g of fatty material}}{\text{percentage of polyunsaturated fatty acids}}$$

is higher than 0.6, with yields of better than 35%, and generally from 40 to 54% for the present-day varieties and which may go up to 75% for varieties of palm oil which have a high unsaturated content, for example the Guineansis-Melanococca hybrid.

In order better to appreciate the concept of 'end-of-clouding point' or ECP, we shall now give a brief description of the ways of measuring the ECP: a sample of fatty material (approximately 50 ml) is placed in a test-tube in which a precision thermometer is immersed and which is surrounded by a jacket; the sample is cooled overnight at a temperature of −20° C. and is then placed in a tank containing a bath of water which is thermostatically controlled to a temperature selected in the range of from +25° to +40° C.; as soon as the oil has become clear, the temperature at which the oil has cleared is read from the precision thermometer, this temperature being called the 'end-of-clouding point.'

Performing the process according to the present invention enjoys particularly substantial advantages in the treatment of palm oil, as the process according to the invention provides for optimum utilisation of the palm oil. Indeed, palm oil is extracted from the fruit of the oil palm-tree which is to be found in tropical countries (tropical Africa, Sumatra, Malaysia and tropical America). It is distinguished by its relatively high content of palmitic oil which, as is known, is a $C_{16}$ saturated fatty acid (about 42% with the present-day varieties) and its relatively low content of oleic acid, which is a $C_{18}$ unsaturated fatty acid (about 38% with the same varieties, whereas peanut oil and olive oil respectively contain about 10% and about 15% of palmitic acid, and about 55% and about 65% of oleic acid. This relatively high proportion of palmitic acid is the cause of the low level of resistance to cold of palm oil and the fact that palm oil cannot be used, as it is, as a salad dressing oil in the temperate or cold climates or Europe, North America or Japan.

Besides the advantages which are achieved by optimum utilisation of palm oil, in accordance with the invention, another attraction of the process according to the present invention is that it concentrates and enriches the fluid fraction with natural tocopherols (vitamin E) which are highly attractive by virtue of their anti-oxygen and biological properties. This is illustrated in the following table:

| | Basic palm oil | Desired fluid oil |
|---|---|---|
| Proportion of tocopherols (x) in mg/100g of oil | 58 | 95 |

(x) The proportions of tocopherols are determined by oxido-reduction and then colorimetry using the conventional methods, and expressed as the equivalent of α-tocopherol.

The figures appearing in the above Table concern fatty substances at the same stage of refining (oil coming into deodorisation).

The concentration in the fluid oil of the tocopherols present in palm oil provides the following advantages:

(a) Preservation of taste properties: it is desirable for the most highly unsaturated fraction of oil to be enriched with anti-oxygens, as it is the most sensitive to oxidation.

From this point of view, the process makes it possible to produce a fluid oil which is suitably protected by its natural anti-oxygens and which does not require any addition of synthetic anti-oxygens, such as for example BHA and BHT, the use of which in the foodstuffs industry is under critical survey at the present time.

The less oxidisable solid fractions contain sufficient quantities of tocopherols for this type of product.

(b) Vitamin E/polyunsaturated fatty acids equilibrium: recent works (cf: *The Role of fats in human nutrition*—edited by A. J. VERGROESEN, ch. 9: 'Linoleic acid intake and vitamin E requirement' by F. C. JAGER, pages 381–425: Academic Press, ed. 1975) have demonstrated the importance of tocopherols in the ingestion of polyunsaturated fatty acids and in particular linoleic acid.

In this connection, palm oil appears to have a very good vitamin E/polyunsaturated fatty acids equilibrium (see the Figure on page 425 of the above-quoted work). The process according to the invention provides the advantage of increasing the content of linoleic acid, an essential fatty acid, in the fluid fraction, while concentrating the tocopherols therein, which is a movement in the direction of preserving the good initial equilibrium, whereas such preservation of the good initial equilibrium is not ensured by the prior art processes, for an equivalent proportion of linoleic acid.

If the process according to the present invention enjoys particular attractiveness in regard to its use in the treatment of palm oil from the present-day varieties, it can be just as advantageously applied to the treatment of fresh varieties and to any other fat in which the proportion of saturated fatty acids is too high to ensure that the oil is sufficiently fluid for temperate climates, for a salad oil.

For carrying out the process according to the present invention, operation is preferably in accordance with the following modes:

1. Palm oil, preferably semi-refined, is subjected to an interesterification reaction.

(a) The interesterification reaction may be free (random); in this case, it is carried out in the presence of from 0.1 to 0.2% by weight of a suitable interesterification catalyst, for example, preferably, sodium methylate, or metal sodium or an Na-K alloy, at a temperature of from about 60° to about 80° C., for 30 to 60 minutes, with agitation and in a vacuum or in an inert atmosphere.

(b) The interesterification reaction may be directed; in this case, it may be carried out in an oil phase or in a solvent such as trichlorotrifluoroethane, preferably, or in hexane, in an oil/solvent proportion which is from 1/0.05 to 1/0.4, in the presence of 0.2 to 0.4% by weight of a suitable catalyst, for example sodium methylate or metal sodium or an Na-K alloy, at a temperature of from 30° to 40° C., for a period of from 1 hour to 24 hours, preferably 1 to 3 hours, with agitation and in a vacuum or in an inert atmosphere.

Once the interesterification operation, whether free or directed, has been taken to the required stage, at the end of the period of time indicated above, the catalyst is rendered inactive by the addition of 2 to 3% by weight of water or 1% of glacial acetic acid, and removed by any suitable means.

The interesterified fatty material is then ready to be fractionated.

2. Fractionation of the interesterified oil produced is then carried out in accordance with one of the following modes:

A. The fractionating step is carried out in accordance with the diagrammatic view shown in accompanying FIG. 1, in a suitable fractionating solvent, preferably in trichlorotrifluoroethane or in hexane, the solvent being present in a proportion of 2 to 7 times the weight of the oil to be fractionated, at a temperature of from −10° to −20° C., for 2 to 4 hours, to recover a fluid fraction with an iodine number of higher than 75, which has the physical-chemical characteristics of the commercially available edible oils (peanut oil or olive oil).

Figure 2:
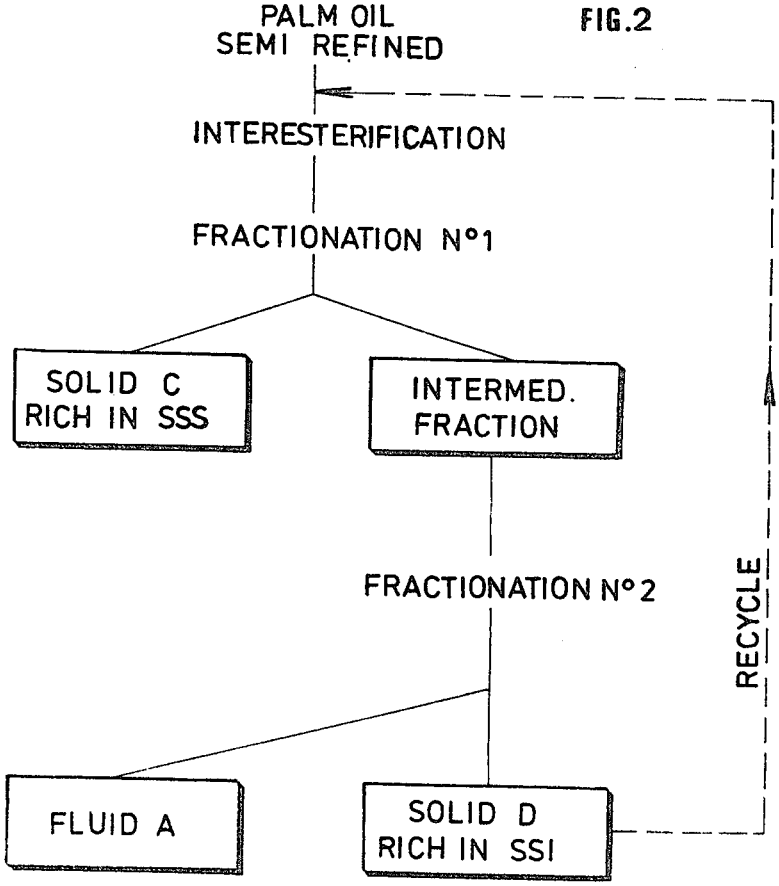

B. The fractionating stage can also be carried out in accordance with the diagrammatic view shown in accompanying FIG. 2, in accordance with the following modes:

(a) A first fractionating step is carried out in a fractionating solvent, for example hexane, trichlorotrifluoroethane, isopropanol and acetone, at temperatures of from 0° to +35° C., the fatty material/solvent weight ratio being from 1/0.5 to 1/7;

(b) the intermediate fraction produced is separated from a solid fraction which is also produced in the fractionating step and is subjected to a second fractionating step in a solvent phase, the solvent preferably being trichlorotrifluoroethane or hexane, and being present in a proportion of from 2 to 7 times the weight of the oil treated, for 2 to 3 hours, at a temperature of from −10° to −20° C. The fluid fraction produced in this way has an iodine number of higher than 75.

The solid fractions produced essentially comprise saturated triglycerides and mixed triglycerides and may be utilised for lipochemical uses and in different sectors of the foodstuffs industry.

C. The solid fraction produced from the second fractionating step as described in B above (see FIG. 2) essentially comprises mixed triglycerides. It may be recycled to the head of the process, substantially in a proportion of about 50% of the solid fraction, for about 50% of palm oil to be treated, so as to be re-subjected to the interesterification operation and to permit a substantial improvement in the overall yield in respect of the fluid fraction.

Besides the measures and arrangements described hereinbefore, the invention comprises further measures and arrangements which will become apparent from the following description.

The present invention more particularly concerns a process for the production of a liquid edible oil from fatty materials having a high content of saturated fatty acids, and the oil which is produced in this way, in accordance with the foregoing measures, and the means for carrying out the process and for producing the oil, and the production trains in which the process indicated above may be included.

The invention will be better understood by means of the further description given hereinafter, which refers to examples of carrying out the process according to the present invention.

It will be appreciated however that these examples of the process are given solely by way of illustration of the invention and do not in any way constitute a limitation on the invention.

EXAMPLES

Example 1

The basic starting oil is a decolorised or deodorised palm oil, and directed interesterification is carried out in the presence of 0.4% of sodium methylate at a temperature which decreases from 60° to 25° C., the duration of the interesterification operation being from 1 to 6 hours.

Interesterification is stopped at the end of this period of time by removal of the catalyst by the addition of 2% of water followed by two washings with water; the oil is dried and fractionated in accordance with the modes described hereinbelow:

(a) a first fractionating step is carried out in 0.5 part of trichlorotrifluoroethane, after maturing for 3 to 4 hours at +20° C.; a fluid fraction is separated by filtration from a solid C which is washed on a filter with fresh solvent, the miscella produced being added to the filtrate;

(b) the filtrate (fluid fraction+solvent) is adjusted to 7 times its weight of trichlorotrifluoroethane with respect to the fatty material present, and is fractionated after maturing for 2 to 3 hours, at −20° C.

The fluid fraction which essentially comprises unsaturated triglycerides is separated from a solid fraction D by filtration. The solvent is removed from the different fractions by any conventional means such as distillation, evaporation, etc.

The results obtained are set out in Table I below.

TABLE I

| | % weight/oil | | Solid C (SES) | | Solid D (SSI) | | Fluid oil desired | | |
|---|---|---|---|---|---|---|---|---|---|
| | SSS | SSI | Yield | I.N. | Yield | I.N. | Yield | I.N. | ECP°C. |
| Basic palm oil I.N. = 54 | 7.7 | 33.6 | — | — | — | — | — | — | — |
| Free interesterification | 14.4 | 27.6 | 18.4 | 12 | 45.5 | 51 | 32.9 | 83 | 12 |
| Directed interesterification: 1 hour | 20.7 | 18.8 | 24.7 | 4.8 | 32.6 | 53 | 40.6 | 87 | 9 |
| Directed interesterification: 6 hours | 28.7 | 10.7 | 30.9 | 1.6 | 21.9 | 57 | 41.6 | 87 | 6 |

EXAMPLE 2

Operation is as described in Example 1, with the difference however that the solid D (SSI) is subjected to an advanced degree of rinsing with the pure solvent, which makes it possible to improve the yield of the desired oil, while preserving a high iodine number, of more than 80, and a satisfactory ECP. The results obtained are set out in Table II below:

TABLE II

| | % weight/oil | | Solid C | | Solid D | Fluid A (initial) | | |
|---|---|---|---|---|---|---|---|---|
| | $S_3$ | $S_2O$ | Yield | I.N. | Yield | Yield | I.N. | ECP |
| Basic palm I.N. = 52 | 5.8 | 31.8 | | | | | | |
| Directed inter. 1h | 20.7 | 17.4 | 24.9 | 4 | 30.3 | 43.6 | 85 | 10 |
| Directed inter. 6h | 29.2 | 11.9 | 30.9 | 2 | 24.1 before rinsing | 44.2 | 87 | 12 |

After rinsing, the solid D gives a rinsed solid D and a rinsing fluid A. The fluid extracted by rinsing is mixed with the initial fluid to give the final fluid, in accordance with the results set out below.

| | Rinsed Solid D | | Rinsing fluid A | | | Final Fluid A | | |
|---|---|---|---|---|---|---|---|---|
| | Yield | I.N. | Yield | I.N. | | Yield | I.N. | ECP |
| Directed inter. 1h | 22.1 | 43 | 8.1 | 76 | + initial fluid A | 51.7 | 81 | 10 |
| Directed inter. 6h | 15.3 | 45 | 8.7 | 81 | | 52.9 | 85 | 11 |

hence the table summarised:

| | Solid C | | Rinsed solid D | | Final fluid A | | | |
|---|---|---|---|---|---|---|---|---|
| | Yield | I.N. | Yield | I.N. | | Yield | I.N. | ECP |
| Directed inter. 1h | 24.9 | 4 | 22.1 | 43 | | 51.7 | 81 | 10 |
| Directed inter. 6h | 30.9 | 2 | 15.3 | 45 | | 52.9 | 85 | 11 |

EXAMPLE 3

1 kg of palm oil is interesterified in the oil phase, that is to say, in free esterification conditions, for 45 minutes, at a temperature of 80° C., and then fractionated at −20° C. in trichlorotrifluoroethane which is present in an oil/solvent proportion of 1/7. There is produced a fluid fraction with an iodine number of 78, in a yield of 38%, and with an ECP of 9°, and which has excellent solidification/liquefaction properties at +15° C. (comparable to peanut oil).

The foregoing examples make it possible to establish the following conditions and characteristics:

It is found that as soon as 20% of SSS is obtained, by directed interesterification, the fluid yield achieved is 52%.

It is also found that, relative to free interesterification, the degree of unsaturation of the olein is improved by directed interesterification. However, as soon as 20% of SSS is obtained, the maximum degree of unsaturation is attained.

It is also found that the unwashed solid D which is produced in Examples 1 and 2 always has a degree of unsaturation which is close to the basic palm oil taken as the starting material. This makes it possible, if appropriate, for this fraction to be recycled to the head of the interesterification cycle, in an approximately 50/50 mixture with whole palm. The effect of this recycling is to improve the overall yield of the fluid fraction of the process.

It is also found that there is a very substantial improvement of the ECP when the interesterification operation is directed, relative to free interesterification.

Finally, the degree of saturation of the solid 5 C increases with the degree of interesterification.

EXAMPLE 4

The basic starting material taken is a randomly interesterified palm with an iodine number of 52.

500 g of this fatty material is mixed with 250 g of hexane; cooling is effected to +15° C., and the crystals are increased in size for a period of 2 hours. After this period, the crystals are filtered and washed.

The filtrate is re-dissolved and diluted so as to have an oil/solvent proportion by weight of $\frac{1}{3}$. Cooling to a temperature of −20° C. is effected, and the crystals are enlarged for a period of 4 hours. After this period, the crystals are filtered and washed with fresh solvent, and after removal of the solvent from each of the fractions, the following results are obtained:

| | I.N. | r |
|---|---|---|
| Solid with a high SSS content | 16 | 18 |
| Intermediate fraction | 60 | 81 |
| Solid with a high SSI content | 41–44 | 36 |
| Fluid | 75–76 | 45 |

The ECP of the fluid fraction is 11 and the liquefaction test is equivalent to peanut oil.

The proportion of reducing tocopherols (active antioxygens) in the fluid fraction produced in accordance with this Example was determined by colourimetry by the bathophenanthroline method which is based on the oxidation of the tocopherols by ferric chloride in alcohol solution, the subsequent formation of the $Fe^{++}$/bathophenanthroline complex, and measurement at 532 mμ of the specific extinction of the coloured complex formed.

This operation gave the following results:

| | | |
|---|---|---|
| Fluid fraction: | before deodorisation: | 75 mg*/100g of oil |
| | after deodorisation: | 40 mg*/100g of oil |

*unit: tocopherols expressed in mg of α-tocopherol for 100 g of oil.

EXAMPLE 5

Palm oil from the Guineansis-Melanococca hybrid with an iodine number of 68 is subjected to free or directed interesterification, in accordance with the conditions of the invention.

375 g of trichlorotrifluoroethane is added to 375 g of this sample; the mixture is cooled to 0° C. and left at this temperature for 3 hours. The crystals which are formed are filtered and washed.

This operation produces on the one hand a solid with a high trisaturated content (SSS) and on the other hand a filtrate containing the intermediate fraction which is adjusted with solvent to a fatty material/solvent ratio of 1/7 by weight and which is cooled to −20° C.; it is left at this temperature for 3 hours. The crystals produced, which have a high disaturated-monounsaturated content, are filtered and washed, and the filtrate contains the fluid fraction of the palm oil, with a high content of unsaturated triglycerides.

The following results are obtained, after removal of the solvent from each of the fractions:

| | After Free inter. | | After directed inter. 1 h at + 35° C. | | After directed inter. 6 hours at + 35° C. | |
|---|---|---|---|---|---|---|
| | r % | I.N. | r % | I.N. | r % | I.N. |
| Solid SSS | 9–10 | 23–24 | 18 | 21 | 20–23 | 32–38 |
| Solid SSI | 19–21 | 45–47 | 14 | 50 | 15–17 | 50–52 |
| Fluid | 69–71 | 78–79 | 68 | 84 | 61–63 | 85 |

This Example clearly shows that, as from a 1 hour period of directed interesterification, the fluid fraction obtained is equivalent to that produced after 6 hours of directed interesterification, and the fluid fraction obtained is nonetheless more highly unsaturated than that produced after free interesterification, and in a yield which is greatly superior to that which is obtained with palm oil of the Elais Guineansis type.

EXAMPLE 6

1 kg of palm oil is fractionated at −20° C. The oil/trichlorotrifluoroethane ratio by weight is 1/7. This operation produces a fluid fraction with an iodine number of 72, in a yield of 43%.

The characteristics in respect of liquefaction and solidification of this fluid are determined by measuring the end-of-clouding point and stability at +15° C., and it is compared with that of the other fluids (Table III).

TABLE III

| | Fluid Ex. 6 non-inter | Peanut | Fluid Ex. 1 free inter | Fluid Ex. 1 inter 1 h | Fluid Ex. 1 inter. 6 h | Fluid Ex. 2 inter 1 h | Fluid Ex. 2 inter 6 h | Fluid Ex. 3 free inter. | Fluid Ex. 4 free inter. | Fluid Ex. 5. free inter. |
|---|---|---|---|---|---|---|---|---|---|---|
| ECP (°C.) | 14.5 | — | 12 | 9 | 6 | | | 9 | 9 | 11 |
| Stability at +15° C. | incomplete liquefaction remains cloudy at this temperature | complete liquefaction, remains clear at this temperature | | | ← | As peanut | | | → | |
| I.N. | 72 | | 83 | 87 | 87 | 81 | 85 | 78 | 78 | 75 |

This Table shows the influence of the free or directed interesterification stage, on the physical-chemical characteristics of the final fluid fraction required.

It is found indeed that, after interesterification, the degree of unsaturation of the fluid increases at the same time as there is a fall in the end-of-clouding point and an improvement in the liquefaction test which becomes comparable to peanut oil.

It is worth noting in this Table that only the fluid of Example 6, which is produced without previous interesterification, is not satisfactory from the point of view of its characteristics.

The fluids produced in Examples 1 to 5 above are comparable to peanut oil.

So that the fluid fraction may be compared to peanut oil as regards its capability for solidification/liquefaction, the fluid fraction should conform to the following specifications:

| | |
|---|---|
| S = saturated | SSS < 0.7% |
| 0 = oleic acid | $S_20$ < 10% |
| | ECP < 12° C. |

Moreover, the liquefaction test as described hereinafter must be equivalent to the test with peanut oil, as can be seen from Table IV hereinafter:

TABLE IV

| | SSS % | $S_2O$ % | ECP °C. | Liquefaction | Storage + 2 months at + 15° C. |
|---|---|---|---|---|---|
| Free interesterification | 0.4 | 8.1 | 8 | good | clear |
| | 0.1 | 10 | 15 | bad | deposit |
| Directed interesterification | | | | | |
| Final fluid Example 2 | | | | | |
| 1 hour | 0.3 | 4 | 10 | good | clear |
| 6 hours | 0.1 | 3.5 | 11 | good | clear |

The characteristics in regard to solidification and liquefaction of the fluid fractions according to the present invention are determined by measuring their end-of-clouding point, as indicated above, and their stability at 15° C. The solidification/liquefaction test comprises cooling the oil overnight at 0° C., and observing the liquefaction time for the oil when restored to an ambient temperature of +15° C. The liquefaction time is taken when the oil is perfectly clear and is compared to the time required for liquefaction of peanut oil which has been cooled under the same conditions as the fluid according to the invention.

Table V below gives the chromatographic composition of the fluid-type fractions which are produced in accordance with the present invention, in comparison with that of commercially available edible oils.

TABLE V

| | Peanut oil Africa (average) | Olive oil Spain (average) | Olive oil Tunisia (average) | Directed inter. 1 Hour: Ex. 1 | Directed inter. 6 hours: Ex. 2 | Free inter. Ex. 3 |
|---|---|---|---|---|---|---|
| C 12–C 14 | | | | 1.8 | 1.7 | 1.2 |
| C 16 | 9.5 | 10.8 | 17.3 | 19 | 15.6 | 22 |
| C 18 | 1.7 | 3.1 | 2.0 | 2 | 1.8 | 2.7 |
| C 18= | 63.7 | 78.5 | 62.1 | 58 | 61.3 | 54.5 |
| C 18== | 18.5 | 5.7 | 15.0 | 17.3 | 17.9 | 18.9 |
| C 20 | 1.5 | 0.3 | 0.2 | 0.3 | 0.1 | 0.4 |
| C 20= | 1.3 | — | 0.3 | <0.1 | 0.3 | — |
| C 22–C 24 | 3.7 | — | — | — | — | — |
| Total of saturateds | 16.4 | 14.2 | 19.5 | 23.1 | 19.2 | 26.3 |
| Total of unsaturateds | 83.8 | 84.2 | 77.4 | 75.3 | 79.5 | 73.4 |

It will be apparent from the foregoing description that, irrespective of the ways in which the process is carried out and the ways in which it is applied, the invention provides a process for the production of a liquid edible oil from fatty materials which have a high content of saturated fatty acids, and the oil produced by the process, which have substantial advantages over the previously known processes seeking to achieve the same aim, some of which advantages were set out hereinbefore and others of which will be apparent from the use of the processes.

As will be seen from the foregoing, the invention is no way limited to those of its modes of performance and use which have been described in greater detail hereinbefore; on the contrary, the invention embraces any alternatives which may be envisaged by the man skilled in the art, without departing from the limits or the scope of the present invention.

We claim:

1. A process for the production of an edible oil from natural fatty substances having a high content of saturated fatty acids, comprising in a first stage, interesterification of the natural fatty substance to be treated at a temperature in the range 20° to 80° C. in the presence of a suitable interesterification catalyst and, in a second stage, subjecting the interesterified fatty material to at least one fractionating step at a temperature in the range −20° to +35° C., by means of a suitable solvent for fractionating fats in order to produce, in a yield of higher than 35%, a fluid fraction substantially comprising unsaturated triglycerides free of trans isomers and having an iodine number of more than 75, an end-of-clouding point lower than 12° C., a content of trisaturated triglycerides less than 0.6%, a content of disaturated-monounsaturated triglycerides less than 10%, and a solidification/liquefaction time at +15° C. comparable to that of peanut oil.

2. A process according to claim 1 in which the natural fatty substance is palm oil or a palm oil fraction having a ratio between saturated and unsaturated substances of from 0.3:1 to 1.2:1 and, in the product, the concentration in respect of tocopherols is enriched with respect to the content of tocopherols in the palm oil used while the tocopherols: polyunsaturated fatty acids ratio of the palm oil is preserved.

3. A process according to claim 1 or 2 in which the fatty material to be treated is subjected to a free interesterification process in oil phase at a temperature of from 60° to 80° C. for a period of from 30 to 60 minutes in the presence of a suitable interesterification catalyst.

4. A process according to claim 1 or 2 in which the fatty material to be treated is subjected to a directed interesterification process in oil phase at a temperature in the range 20° to 40° C. for a period of from 1 to 24 hours in the presence of a suitable interesterification catalyst.

5. A process according to claim 4 in which the said period is from 1 to 3 hours.

6. A process according to claim 1 or 2 in which the fatty material to be treated is subjected to a directed interesterification process in solvent phase at a temperature in the range 20° to 40° C. for a period of from 1 to 24 hours in the presence of a suitable interesterification catalyst.

7. A process according to claim 6 in which the solvent for the directed interesterification operation is a halogenated or non-halogenated hydrocarbon.

8. A process according to claim 7 in which the solvent is trichlorotrifluoroethane or hexane.

9. A process according to claim 6 in which the said period is from 1 to 3 hours.

10. A process according to claim 6 in which the solvent is used in a fatty material:solvent ratio by weight of from 1:0.005 to 1:0.4.

11. A process according to claim 1 in which the interesterification catalyst is an alkali metal alcoholate, metallic sodium or a sodium-potassium alloy, the catalyst being present in a proportion of from 0.1 to 0.4% by weight with respect to the weight of the fatty material to be treated.

12. A process according to claim 11 in which the catalyst is sodium methylate.

13. A process according to claim 1 in which the fractionating stage is carried out in a single operation, using as solvent trichlorotrifluoroethane or hexane, at a temperature in the range −20° C. to −10° C., the fatty material:solvent weight ratio being from 1:2 to 1:7.

14. A process according to claim 1 in which the fractionating stage comprises at least two successive fractionating operations, namely a first operation for fractionating the interesterified fatty material by means of trichlorotrifluoroethane, hexane, isopropanol or acetone, present in an oil:solvent ratio by weight of from 1:0.5 to 1:7, for a period of from 2 to 4 hours, at a temperature of from 0° to +35° C., followed by a second operation of fractionating the fluid fraction produced from the first fractionating operation in trichlorotrifluoroethane or hexane, present in an oil:solvent ratio by weight of 1:2 to 1:7, for a period of from 2 to 4 hours, at temperatures in the range −10° to 20° C., to produce an edible fluid fraction that essentially comprises unsaturated triglycerides, which is recovered by separation of the solid fraction also produced.

15. A process according to claim 14 in which the solid fraction produced from the second fractionating operation is recycled to the head of the process, in the fatty material to be treated, so as to be interesterified jointly with the fatty material to be treated.

16. A fluid fraction produced by carrying out a process according to any one of claims 1, 2 or 11–15 and comprising unsaturated triglycerides with an iodine number of more than 75, said fraction having no trans isomers, and conforming to the following specifications:

end-of-clouding point: lower than 12° C.

proportion of trisaturated triglycerides: lower than 0.6% proportion of disaturated-monounsaturated triglycerides: lower than 10% liquefaction time at +15° C.: equivalent to that of peanut oil proportion of tocopherols: about 0.038% by weight $$\frac{\text{mg of tocopherols per 100 g of fatty material}}{\text{percentage of polyunsaturated fatty acids}} : \text{higher than } 0.6$$

* * * * *